US007566234B2

(12) United States Patent
Hackemack et al.

(10) Patent No.: US 7,566,234 B2
(45) Date of Patent: Jul. 28, 2009

(54) CONNECTOR APPARATUS WITH CODE MEANS

(75) Inventors: Frank Hackemack, Detmold (DE); Bernhard Jaschke, Lage (DE); Matthias Bönsch, Bielefeld (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 11/811,505

(22) Filed: Jun. 11, 2007

(65) Prior Publication Data

US 2007/0293096 A1 Dec. 20, 2007

(30) Foreign Application Priority Data

Jun. 16, 2006 (DE) ..... 20 2006 009 459 U

(51) Int. Cl.
*H01R 29/00* (2006.01)

(52) U.S. Cl. ..... 439/188; 439/189; 200/51.1

(58) Field of Classification Search ..... 439/188, 439/189; 200/51.1

See application file for complete search history.

(56) References Cited

U.S. PATENT DOCUMENTS

| | | | | |
|---|---|---|---|---|
| 4,850,888 | A * | 7/1989 | Denlinger et al. | 439/188 |
| 5,405,268 | A * | 4/1995 | Gazzara et al. | 439/188 |
| 5,509,817 | A * | 4/1996 | Tsuji | 439/188 |
| 5,893,778 | A * | 4/1999 | Mansutti | 439/701 |
| 5,897,389 | A * | 4/1999 | Dietz et al. | 439/188 |

FOREIGN PATENT DOCUMENTS

| | | | |
|---|---|---|---|
| DE | 23 62 060 | A1 | 6/1975 |
| DE | 86 05 765 | U1 | 8/1986 |
| DE | 88 00 296 | U1 | 3/1988 |
| DE | 42 01 219 | C1 | 7/1993 |
| DE | 195 00 156 | A1 | 7/1995 |
| DE | 44 32 726 | A1 | 3/1996 |
| DE | 197 21 501 | A1 | 12/1997 |
| DE | 197 53 843 | A1 | 8/1998 |
| DE | 20 2004 006 125 | U1 | 9/2005 |
| EP | 0 702 427 | A2 | 3/1996 |
| EP | 1 331 693 | A2 | 7/2003 |
| EP | 1 505 692 | A1 | 2/2005 |
| WO | WO 98/31157 | A | 7/1998 |

* cited by examiner

*Primary Examiner*—Truc T Nguyen
*Assistant Examiner*—Xuong M Chung-Trans
(74) *Attorney, Agent, or Firm*—Lawrence E Laubscher, Sr.; Lawrence E Laubscher, Jr.

(57) ABSTRACT

A connector block arrangement includes a first connector block housing having a row of first contacts, a second connector block housing having a row of second contacts in engagement with the first contacts when the connector block housings are in a connected condition, a conductive jumper device having a base portion and a plurality of resilient fingers normally connecting together a group of the second contacts, and an electrically-insulated code device carried by one of the housings for selectively disengaging from the jumper device at least one of the contacts of the second contact group. The code device has a planar generally comb-like configuration including a base portion arranged in an opening contained in either one of the connector block housings, and at least one code bar portion operable to separate a resilient finger of the jumper device from the corresponding contact to be disengaged.

15 Claims, 11 Drawing Sheets

CONNECTOR APPARATUS WITH CODE MEANS

BACKGROUND OF THE INVENTION

1. Field of the Invention

A connector block arrangement includes a first connector block housing having a row of first contacts, a second connector block housing having a row of second contacts in engagement with the first contacts when the connector block housings are in a connected condition, a conductive jumper member including a base portion and a plurality of resilient fingers normally connecting together a group of the second contacts, and an electrically-insulated code device carried by one of the housings for selectively disengaging from the jumper member at least one of the contacts of the second contact group. The code device has a planar generally comb-like configuration including a base portion arranged in an opening contained in either of the connector block housings, and at least one code bar portion operable to separate a resilient finger of the jumper member from the second contact to be disengaged.

2. Description of Related Art

Connector block arrangements of the plug-and-socket type are well are known in the prior art, as shown by the prior German patents Nos. DE 197 21 501 A1 and DE 20 2004 006 125 U1, and the European patent No. EP 15 05 692 A1. Such connector block arrangements have metal subassemblies with first contacts that are to be connected with each other and with second contacts that are to be connected with the first contacts, whereby a plurality of conductors leading to the connector block can be attached. Moreover, the German patent No. DE 86 05 765 U1 shows a probe for extension spring clips; German patent No. DE 44 32 726 A1 discloses a separating disc arrangement, and German patent No. DE 42 01 219 C1 shows the use of a cross-connector for terminal blocks.

It is also known that one can attach bridging or jumper devices on the metal subassemblies, thereby to connect metal subassemblies with each other internally of the connector block. This present the problem that in various practical cases, it is necessary to deactivate the cross-connecting or bridging means either before the closing of the first contacts, or thereafter, or to separate it from the metal subassemblies. To this end, it is proposed to use coding elements for this purpose having at least one or several flat plug segments and consist of an insulating material or substance such as a non-conducting plastic. A comb-like design of the coding elements with a base segment and several flat plug segments arranged thereupon is particularly advantageous because it can be handled at reasonable cost as well as quickly and simply. This arrangement also makes it possible, all at once, to separate several contacts to the jumper cross-linking means.

In a preferred manner, each coding element is so designed and can so be mounted on the movable connector block and/or the stationary connector block so that one can optionally make a separation between the crosslink and the first contacts already prior to a contacting between the first contacts of the movable connector block and the first contacts of the stationary counter block or after the contacting of the first contacts of the connector block and the stationary counter block, something that may make good sense and may be advantageous, for example, when wiring current and voltage converters. Using the coding system or the coding elements in their simplest form, it is furthermore possible to open a contact on the connector block, in particular, to the crosslink in the required manner, or to separate the corresponding contact areas.

Preferably, the coding element is easily visible from the outside in the preassembled position. Depending on occupation with current and voltage converters, the user can, perform a specifically application-oriented and preferably externally well recognizable preceding by means of the coding elements in the simplest way, as a result of which, there is also protection of the appliances against faulty wiring.

SUMMARY OF THE INVENTION

Accordingly, a primary object of the present invention is to provide a connector arrangement for selectively connecting a plurality of external conductors with a load such as a multi-circuit printed circuit board, including a first connector block having a row of first contacts connected with the load contacts, respectively, a second connector block having second connectors connected with the conductors, respectively, conductive jumper means having resilient fingers connecting together a group of the second contacts, and a non-conductive code member carried by one of the connector blocks for disengaging at least one of the resilient fingers of the jumper member from the associated second contact, thereby to disengage said associated second contact from the group. Accordingly, an external conductor is connected by the connector blocks with those first contacts—and accordingly the associated load terminals—as controlled by the number of code bars on the code member.

According to a more specific object of the invention, the code member may be mounted in an opening contained in either of the connector blocks. In one case, the code member comprises a comb-like member having a base portion mounted in a recess contained in the first connector block that is connected with the load. In another arrangement, the code member is mounted in a through passage that is contained in the movable connector block. In both cases, the non-conductive code bars of the code member are inserted to separate the desired resilient fingers from engagement with bus bar portions of the corresponding second contacts, thereby to remove from the group the selected second contacts.

A more specific object of the invention is to provide a jumper member having a generally V-shaped cross-sectional configuration including a base portion, and plurality of resilient finger portions arranged at an acute angle relative to the base portion. The jumper fingers are resiliently biased toward engagement with leg portions of C-shaped bus bars, respectively, which bus bars are respectively electrically connected with the second contacts on the movable connector block.

A further object of the invention is to provide connector blocks that are assembled from a plurality of housings that are connected by tongue and groove means. Attachment means may be attached to the ends of the movable connector block for fastening the same to a support wall of the stationary contact block assembly.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1A:
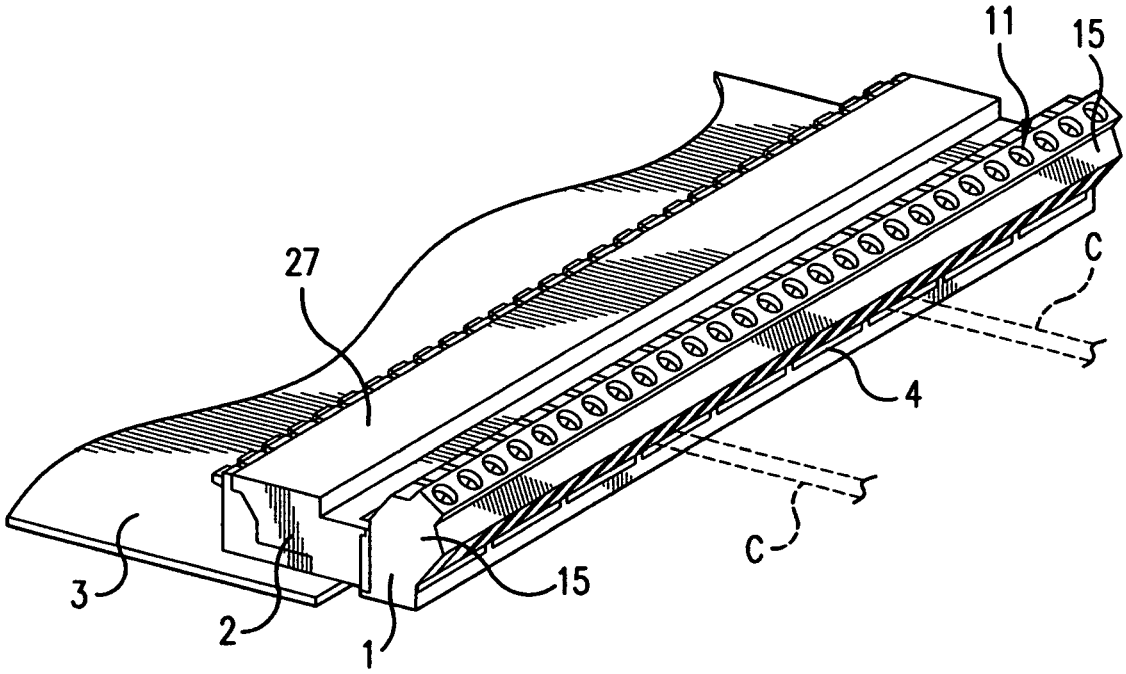
FIG. 1*a* is a perspective view of the a first and second connector blocks of the present invention when in the connected condition.
Figure 8A:
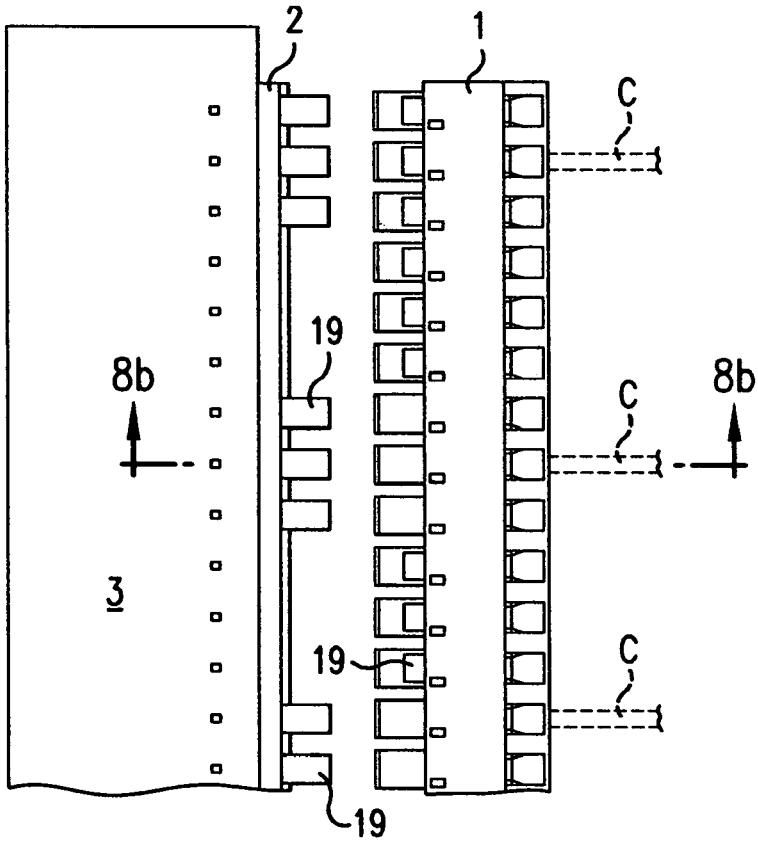
FIG. 8*a* is a top detailed top plan view of the connector block arrangement when in the disconnected condition.
Figure 8B:
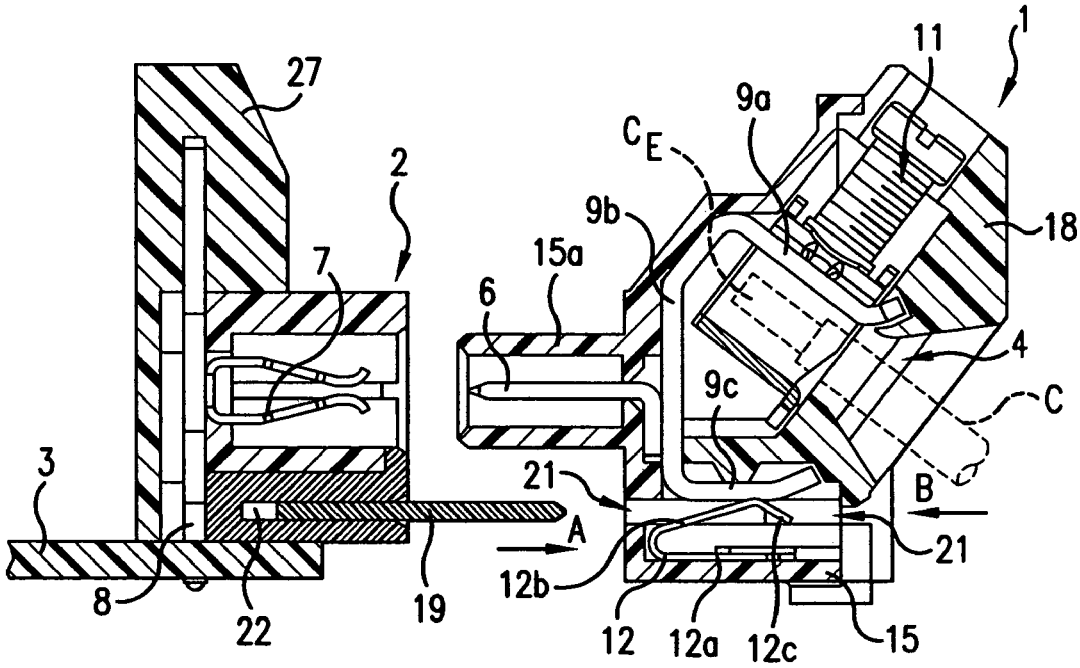
FIG. 8*b* is a sectional view taken along line 8*b* -8*b* of FIG. 8*a;*

Referring first more particularly to FIGS. 1 and 8*b*, the connector block arrangement of the present invention is operable to connect a plurality of external conductors C with selected electrical circuits contained on a printed circuit board 3. To this end, a stationary first connector block 2 is mounted on the printed circuit board 3, and a movable connector block 1 connected with the external conductors C is arranged for displacement between the disengaged condition of FIG. 8*b* and the engaged condition of FIG. 1. The first connector block 2 includes a housing 27 formed from an electrically-insulating synthetic plastic material which supports a longitudinally extending row of tulip-shaped female contacts 7 that are connected by pins 8 with the terminals of the respective circuits on the printed circuit board 3.

The movable connector block 1 includes a sectional housing 15 formed from electrically-insulating synthetic plastic material, which housing contains a row of male electrical contacts 6 that are arranged opposite the female contacts 7, respectively. Each of the male contacts 6 extends outwardly through a protective sleeve portion 15*a* of the housing 15, whereby when the two connector blocks are in the connected condition of FIG. 1, the contacts 6 and 7 are in electrical engagement with each other, and the protective sleeve portion 15*a* extends within a corresponding recess contained in the housing 2. The male contacts 6 are connected with the center portion 9*b* of a C-shaped bus bar 9 having a pair of leg portions 9*a* and 9*c*.

Figure 1B:
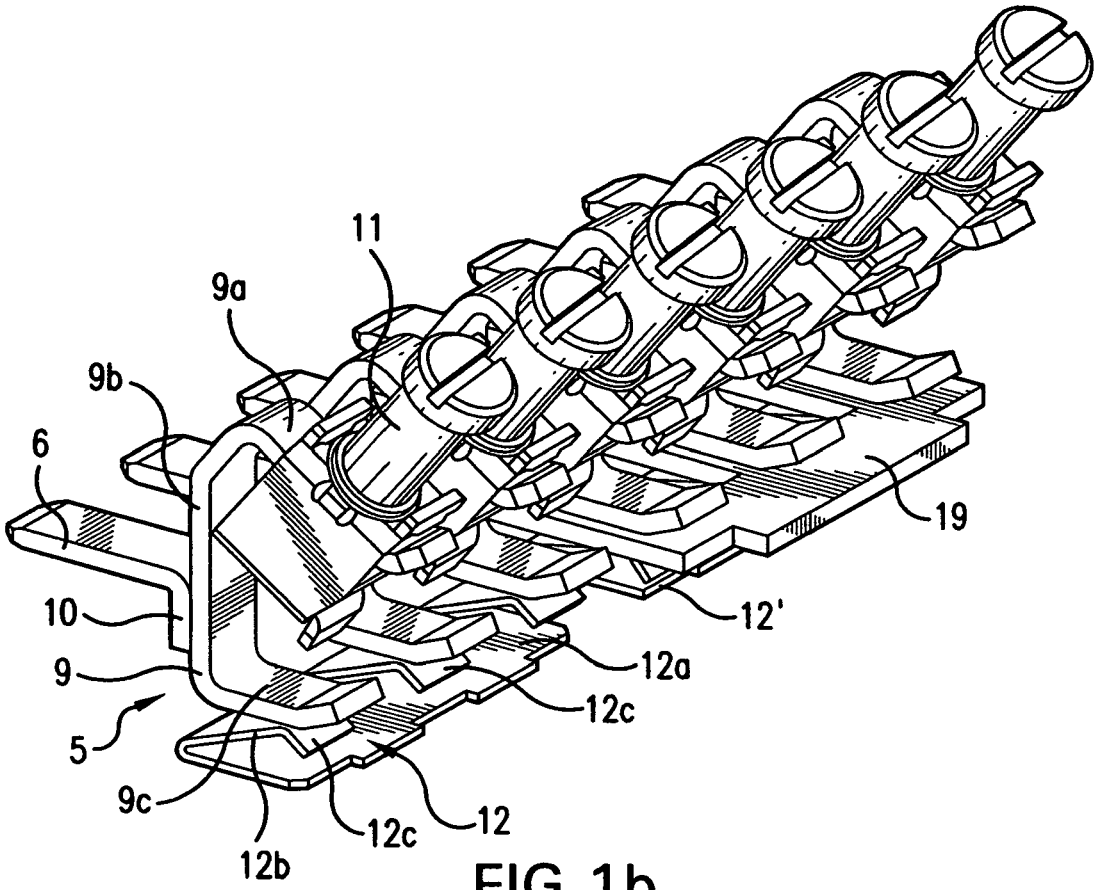
FIG. 1*b* is a detailed perspective of the sub-assembly of the electrical contacts, a jumper device, and a code member that is contained in one of the contact block housings of FIG. 1*a;*

As shown in FIG. 1*b*, groups of the male contacts 6 are electrically connected together by a plurality of conductive jumper members 12 that bridge a plurality of the bus bars 9 connected with the male contacts 6. The jumper member 12 has a generally V-shaped cross-sectional configuration and includes a base portion 12*a* (FIG. 8*b*) supported by the bottom wall of the housing 15, and a plurality of resilient finger portions 12*b* that are reversely bent back at an acute angle from one side edge of the jumper member to a position above the base portion 12*a*. The resilient fingers 12*b* are biased upwardly toward engagement with the second leg portion 9*c* of the bus bar 9. Therefore, the jumper member 12 bridges and electrically engages a group of the bus bars 9, thereby to electrically connect together the associated male contact 6 connected with the bus bars 9. In the illustration of FIG. 1*b*, three bus bars 9, and consequently three male contacts 6, are electrically connected together by the jumper member 12, and—but for the provision of the code member 19—a second jumper member 12' would normally connect together a second group of the male contacts, as will be described in greater detail below.

As shown in FIG. 8*b*, the connector block 1 includes a molded second housing section 18 that contains a plurality of access openings 4 through which the bare end portions of the insulated external conductors are inserted into corresponding receiving areas 10 contained within screw-operated clamping devices 11 that clamp the bare end $C_E$of the associated conductor to the first leg 9*a* of the bus bar 9. Thus, when the connector blocks 1 and 2 are in the assembled connected condition, each conductor of a given group of conductors C, as determined by the jumper member 12, is normally connected with a corresponding selected circuit terminal on the printed circuit board 3 via the associated screw-operated clamping device 11, bus bar leg portion 9*a*, bus bar central portion 9*b*, male contact 6, female contact 7, and connecting pin 8.

Figure 9:
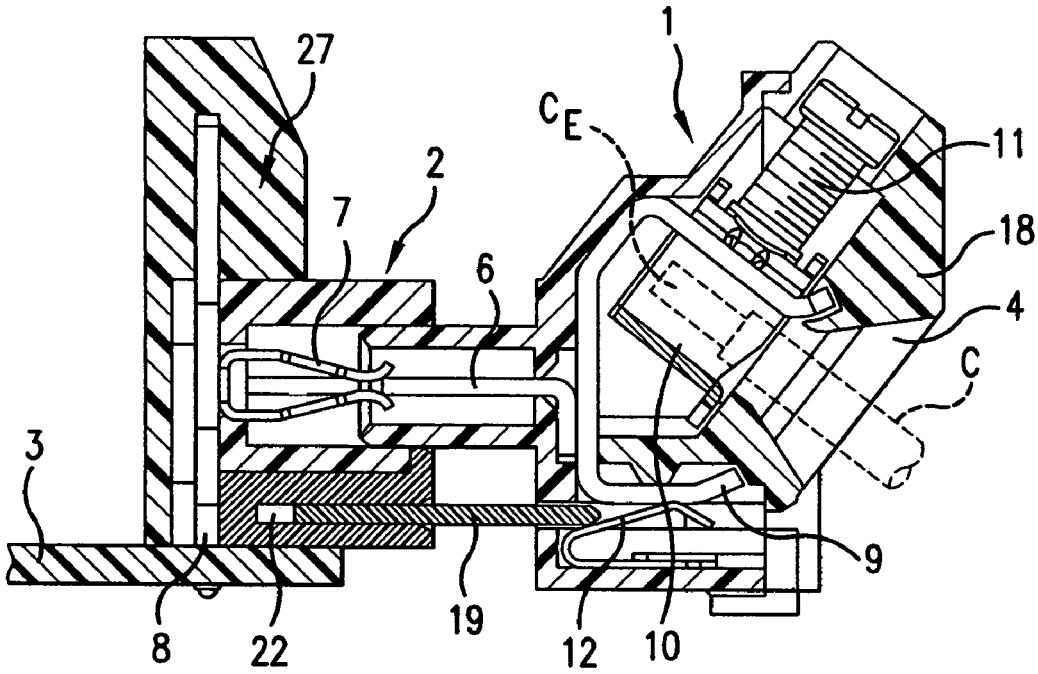
FIGS. 9 and 10 are sectional view correspond to FIG. 8*b* with the connector blocks in the intermediate and in the fully connected conditions, respectively.
Figure 10:
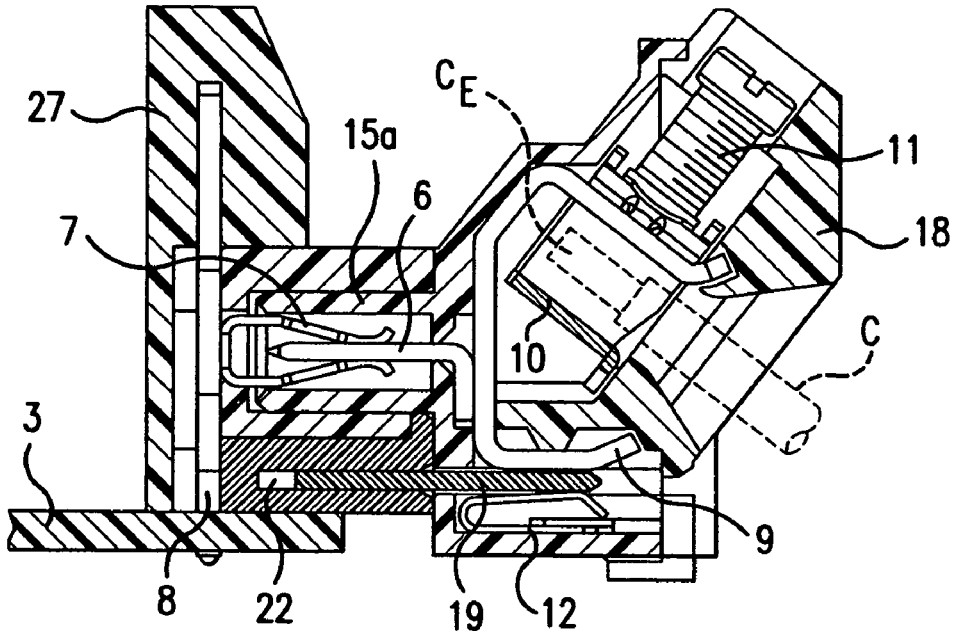
Figure 11A:
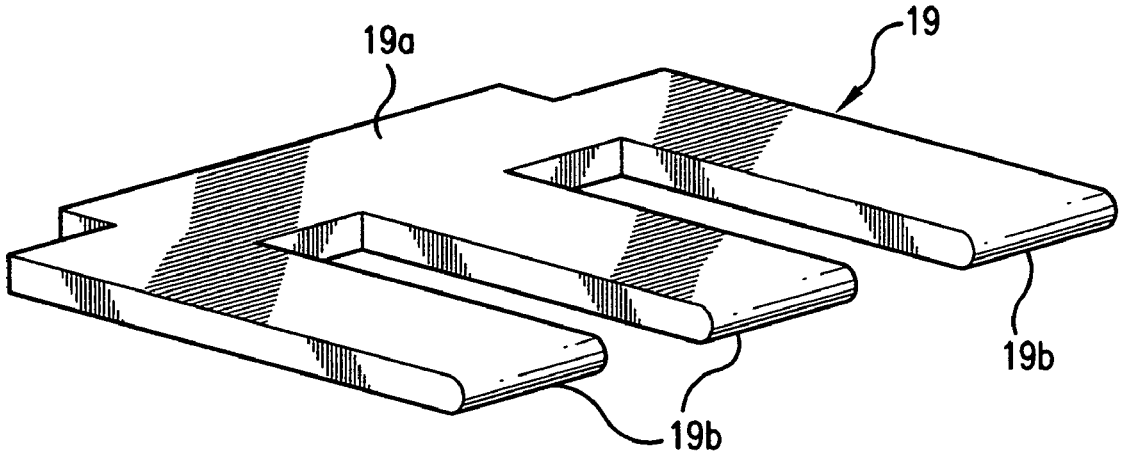
FIG. 11*a* is a perspective view of one of the code members of FIG. 2.

In accordance with a characterizing feature of the present invention, a plurality of code members 19 are provided for selectively deactivating one or more of the resilient fingers 12*b* of the jumper member 12, thereby to disconnect the corresponding conductor C from the group of conductors connected with the jumper member. As shown in FIG. 11*a*, the code member 19 is planar and has a generally comb-shaped configuration including a generally-rectangular base portion 19*a*, and a plurality of code bar portions 19*b* extending orthogonally from said base portion. The code member 19 is formed from a suitable electrical-insulating synthetic plastic material. As shown in FIG. 8*b*, the connector block 2 contains a recess 22 for receiving the base portion 19*a* of a comb member 19, with the code bar portions 19*b* projecting outwardly from the connector block 2 toward the connector block 1. The connector block 1 contains a through slot 21 opposite the code member 19. Thus, as shown in FIGS. 8*b*, 9, and 10, as the connector blocks 1 and 2 are displaced from the disengaged condition toward the fully engaged condition of FIG. 10, the code bar portions 9*b* are introduced into the respective through slots 21, thereby to disengage the resilient finger 12*b* from the associated bus bar leg 9*c* prior to engagement of the male contact 6 with the female contact 7. As shown in FIG. 10, when the connector blocks 1 and 2 are in the fully engaged condition, the conductor C is connected only with the corresponding pin 8 of the conductor block 2. Thus, the number of code bars 19*b* of a code member 19 controls the connection of the various external conductors C to the various corresponding circuits on the printed circuit board 3.

Figure 2:
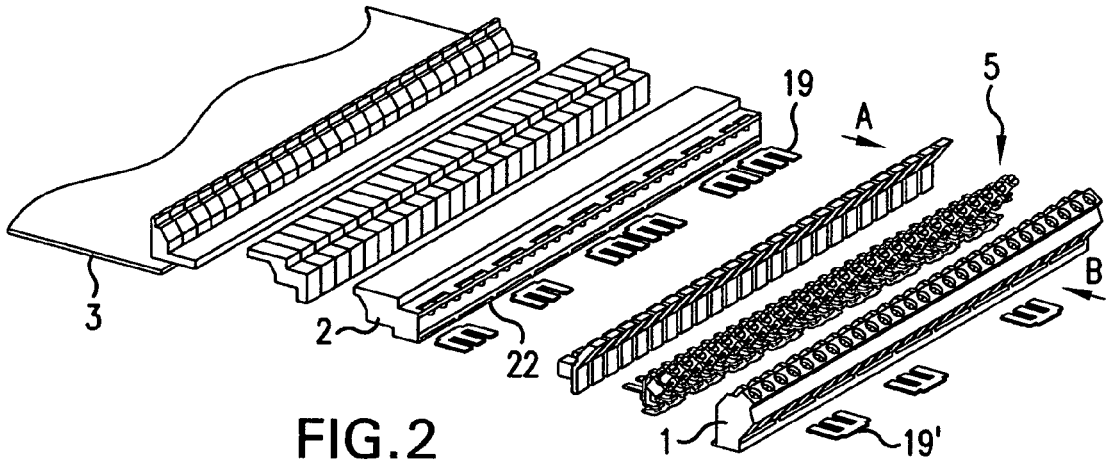
FIG. 2 is an exploded view of the connector blocks of FIG. 1*a*.
Figure 3:
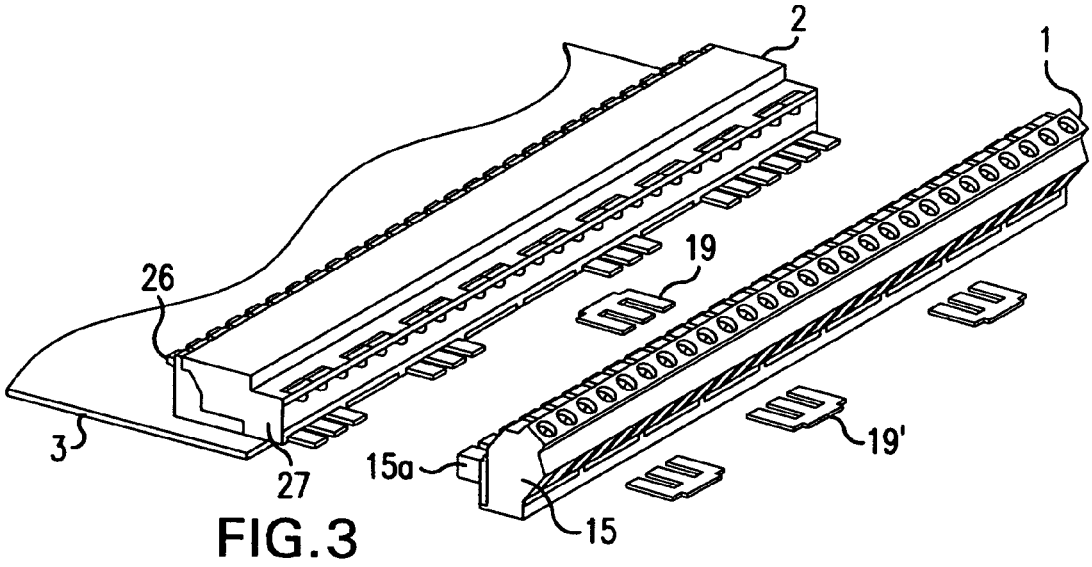
FIG. 3 is a perspective view of the partially assembled connector blocks of FIG. 2.
Figure 4:
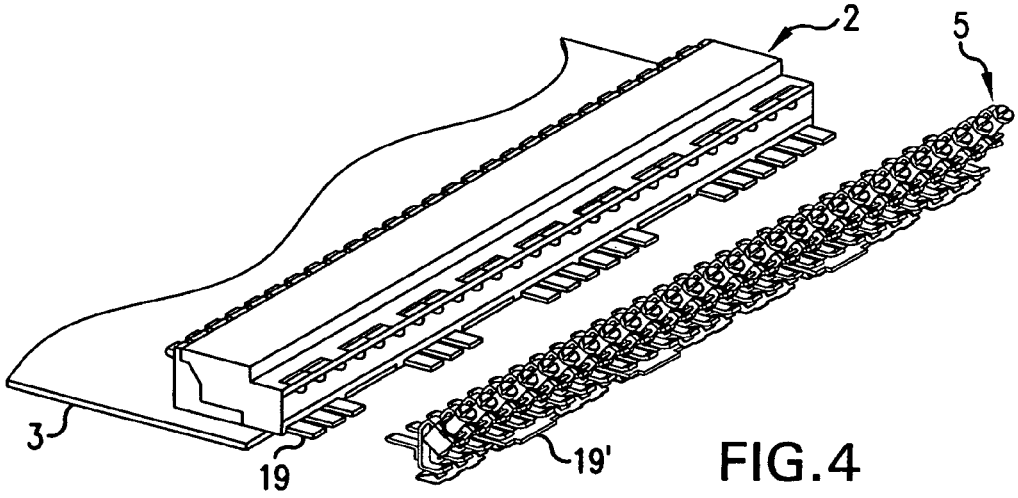
FIG. 4 is a perspective view corresponding to the apparatus of FIG. 3, with certain parts removed.

Referring to FIG. 2, it will be seen that a plurality of first code members 19 are mounted in recesses 22 contained in the connector block 2, and second code members 19' are introduced in the opposite direction into the through passages 21 contained in the connector block 1. In both cases, the length of the code bar portions 19*b* of the code members as such that the code members 19 are visible when the connector blocks 1 and 2 are in the disengaged condition.

Figure 5:
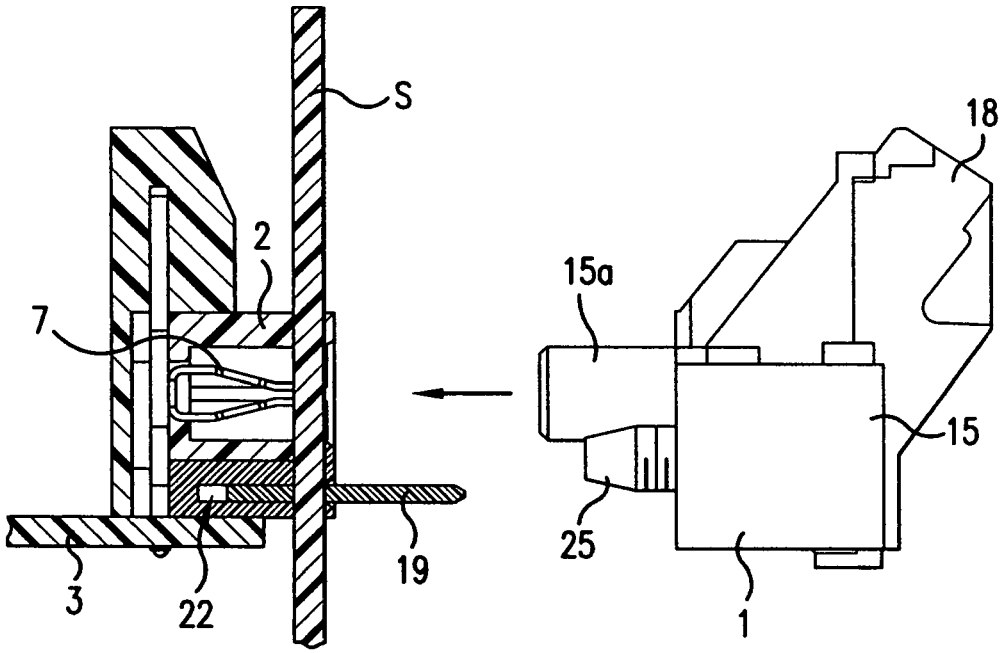
FIGS. 5-7 are schematic side elevation views illustrating the displacement of the movable connector block from the disengaged position toward the fully connected position, all with the code member being carried by the stationary connector block.
Figure 6:
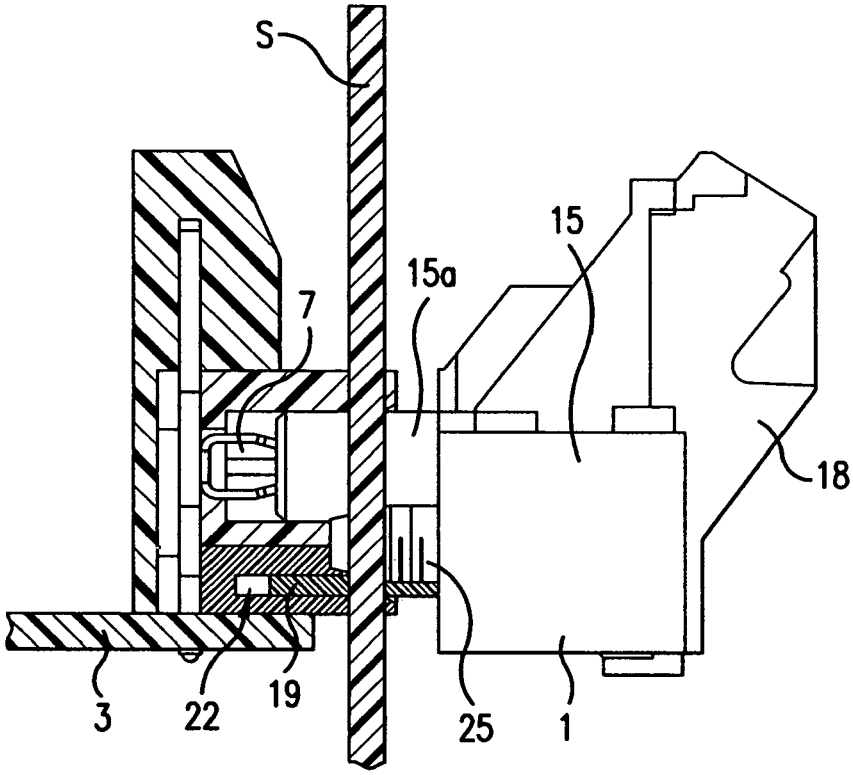
Figure 7:
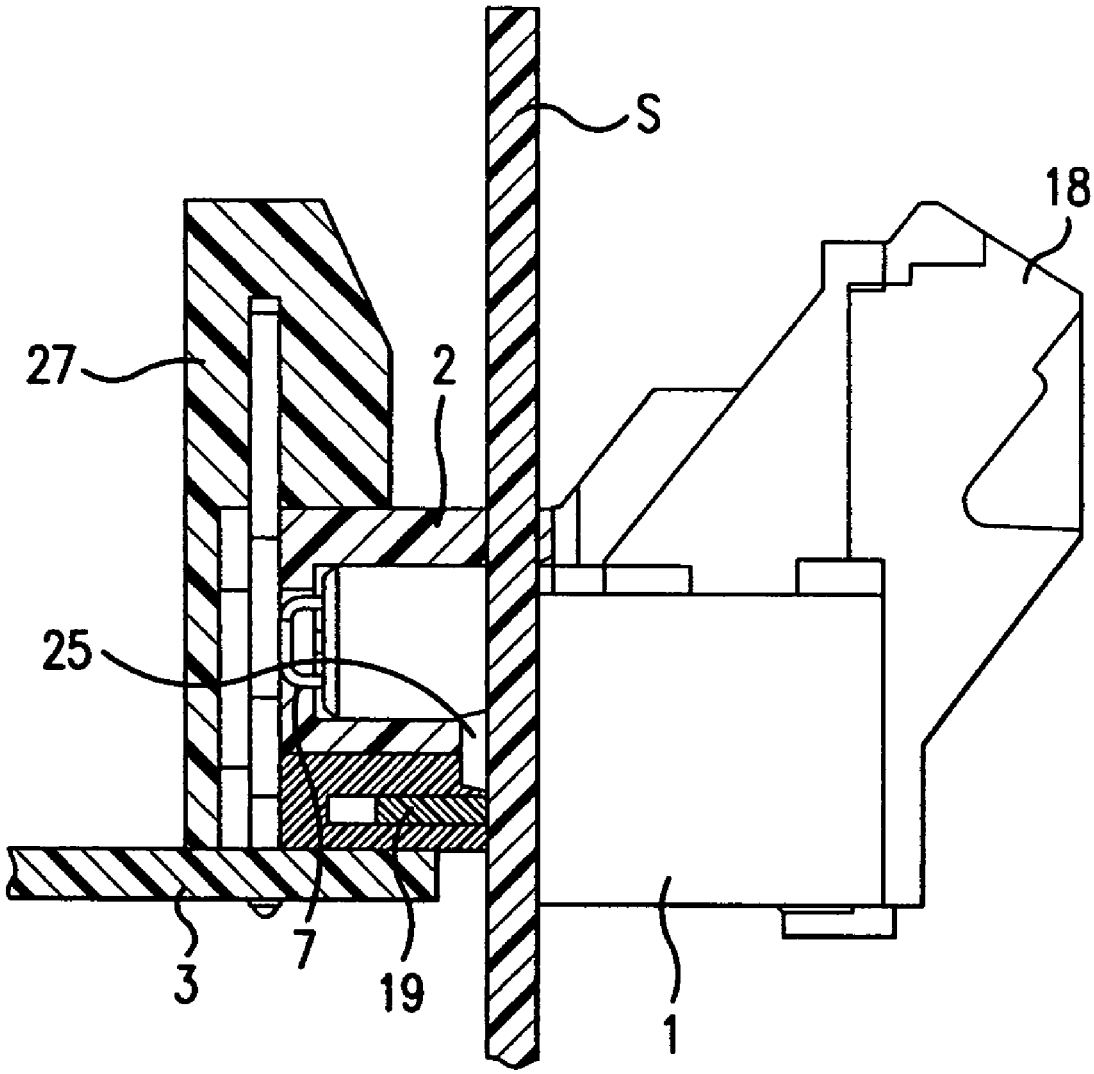
Figure 11B:
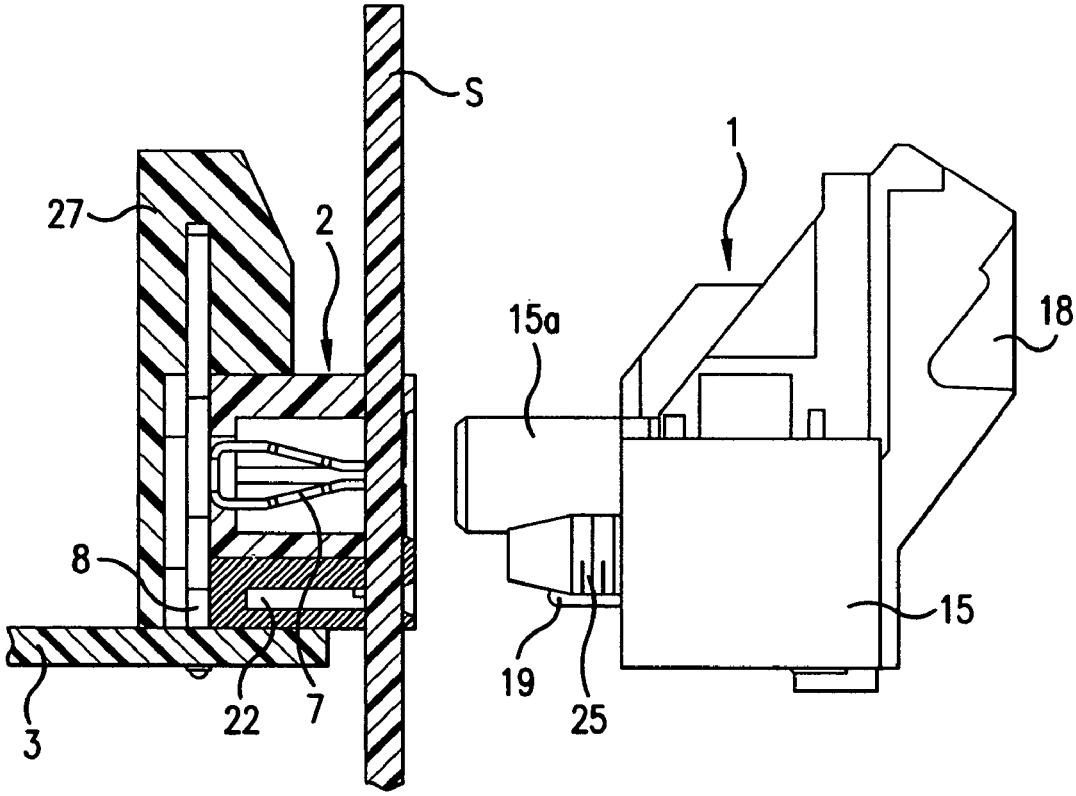
FIGS. 11*b*, 12 and 13 are schematic views illustrating the displacement of the movable connector block, when carrying the code member, between separated, intermediate and fully engaged conditions.
Figure 12:
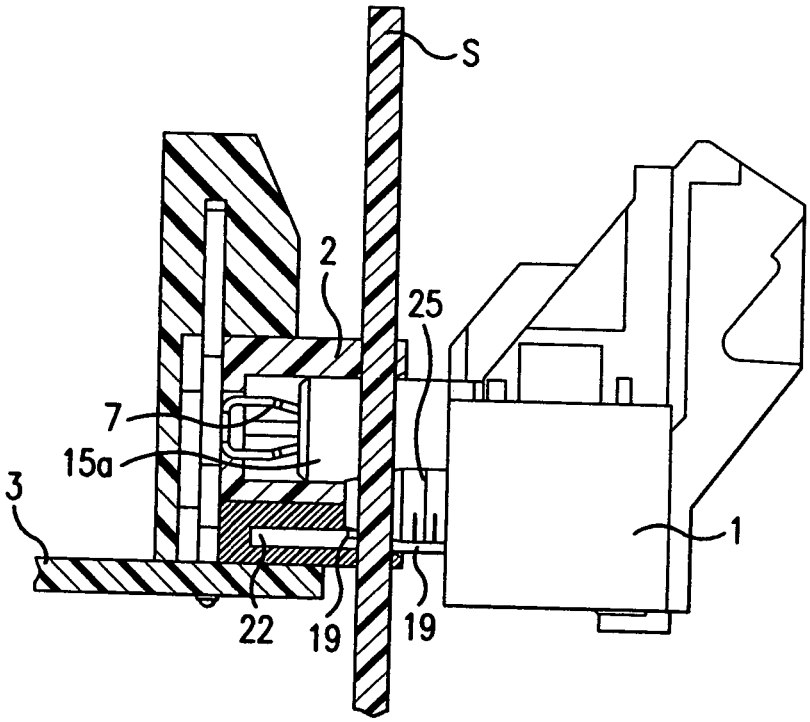
Figure 13:
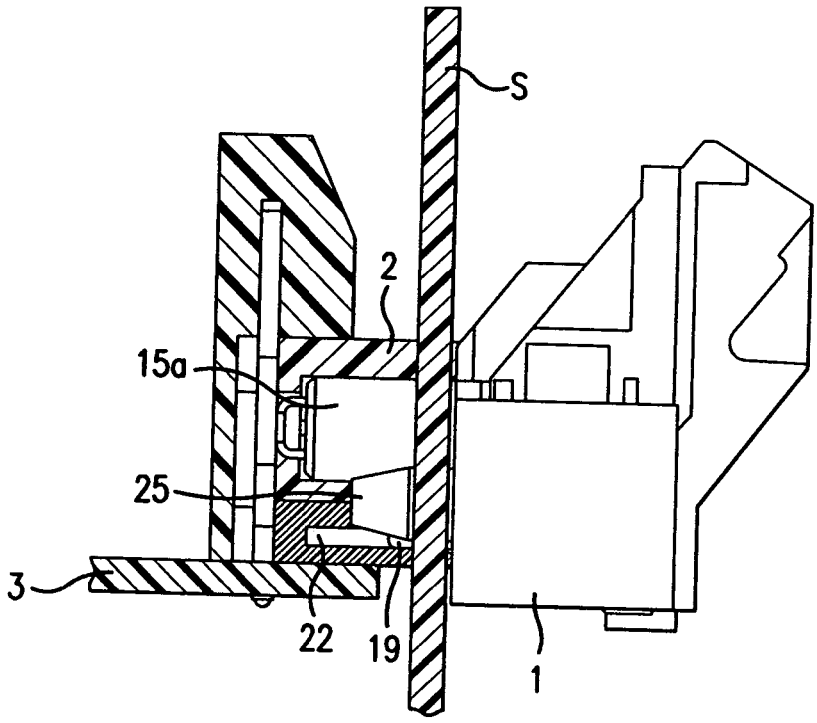

Referring to FIGS. 5-7, it will be seen that when the connector blocks 1 and 2 are displaced together from the separated condition toward the connected position, the code bar 19 carried by the recess 22 contained in the connector block 2 extends within the corresponding through passage 21 contained in the connector block 1, whereupon the corresponding male contacts carried by the connector block 1 are disengaged from the jumper member. Similarly, in FIGS. 11-13, the code member 19 may be connected with the slot 21 contained in the terminal in the connector block 1, whereupon as the connector blocks are displaced toward the fully connected condition of FIG. 13, the code member 19 carried by the connector block 1 is introduced into the recess 22 of the connector block 2.

Operation

In operation, assume that a first insulated external conductor C has a stripped bare end portion connected with one of the screw-operated clamping devices 11 associated with the jumper member 12. In this case, the conductor would be connected with the associated three male contacts 6, the associated three female contacts 7, the associated pins 8, and the associated three terminals on the printed circuit board. If a second conductor were to be connected with the jumper member 12' that is engaged by the code member 19, that conductor would be connected only with a single associated male contact 6, the associated female contact 7, the associated connecting pin 8, and the associated single terminal of the circuit board 3.

Figure 14:
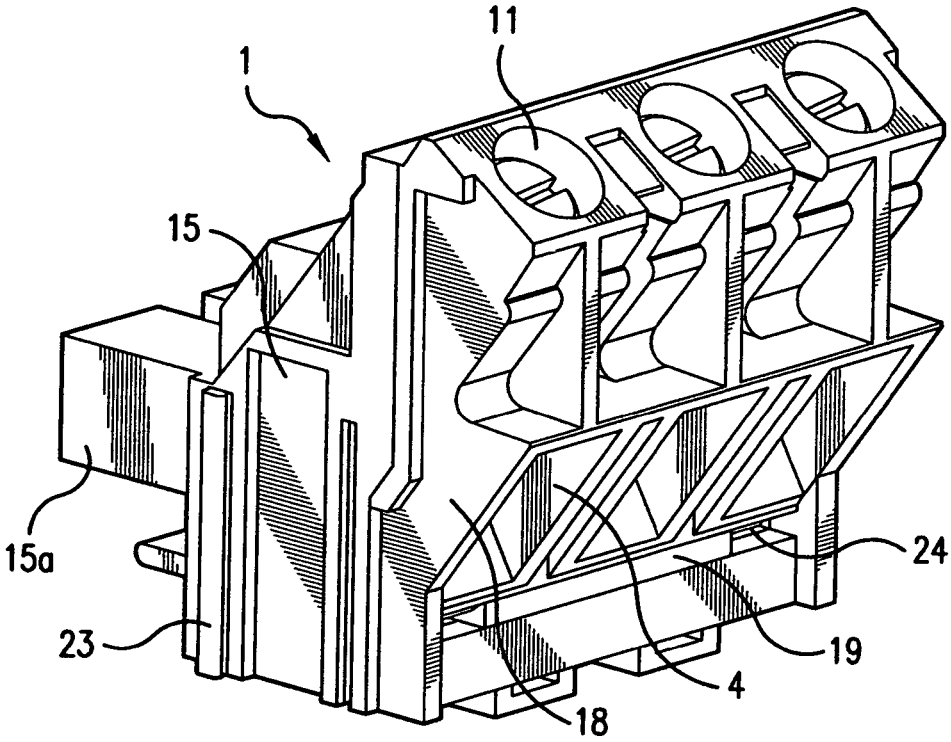
FIGS. 14 and 15 are perspective views of the movable and stationary connector blocks, respectively.
Figure 15:
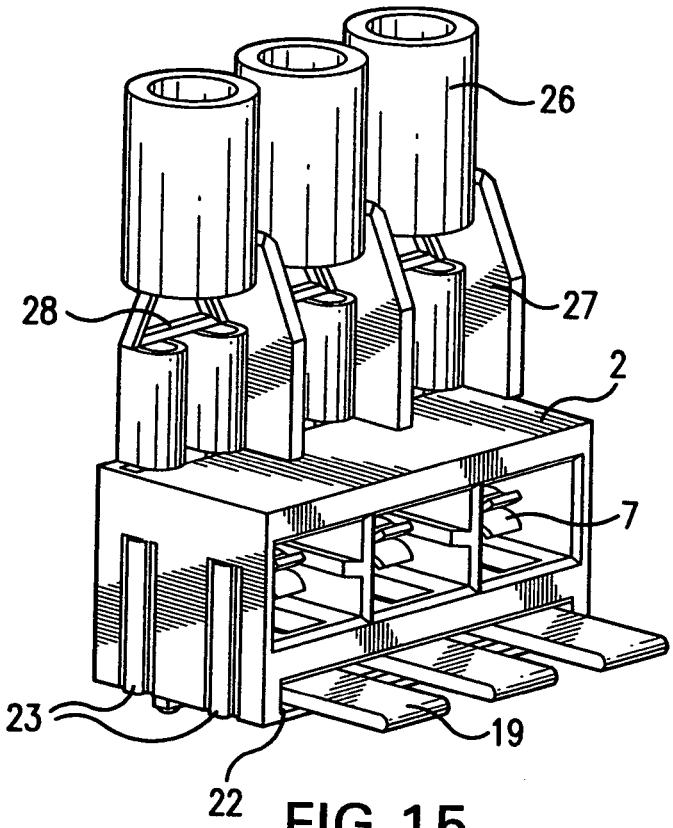
Figure 16A:
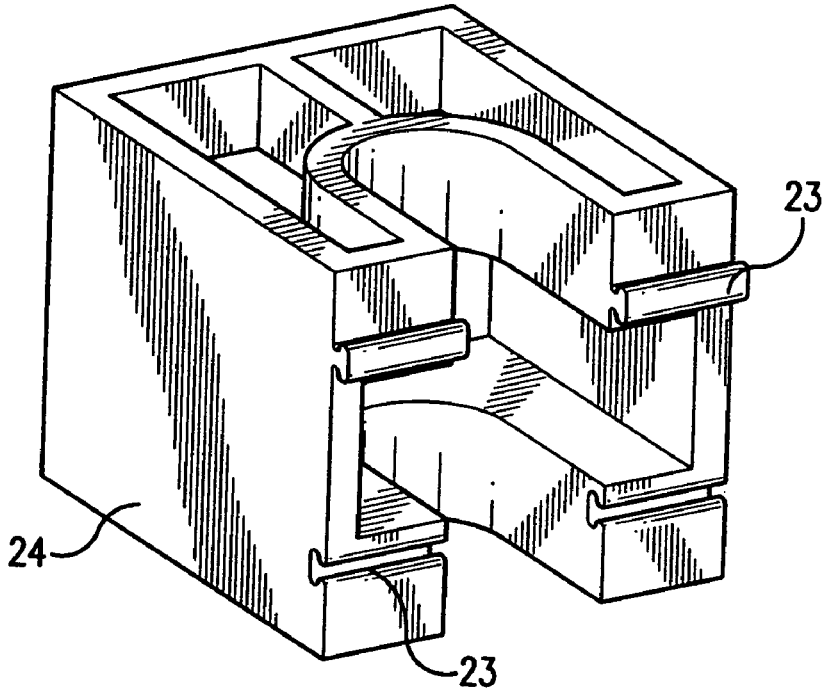
FIG. 16*a* is a front perspective view of the attachment body.
Figure 16B:
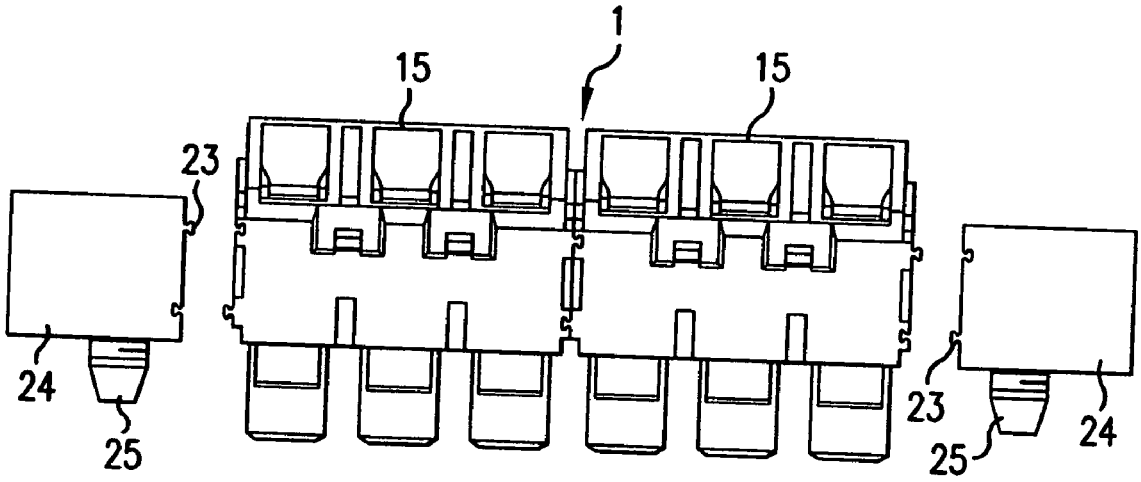
FIG. 16*b* is a top plan and view illustrating the manner of attachment of the attachment bodies of FIG. 16*a* to the ends of a movable connector block.
Figure 17A:
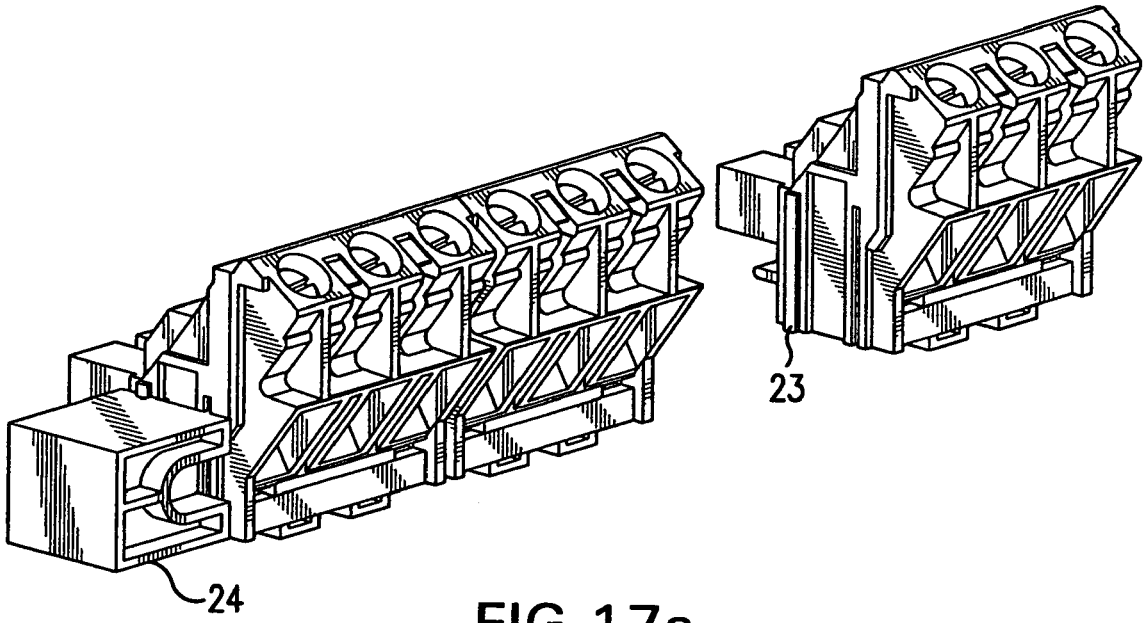
FIG. 17 is a detailed partly exploded rear view of the apparatus of FIG. 16*b*.
FIG. 17*b* is a front perspective view of the attachment body of FIG. 16*a* provided with a screw fastening member.
Figure 17B:
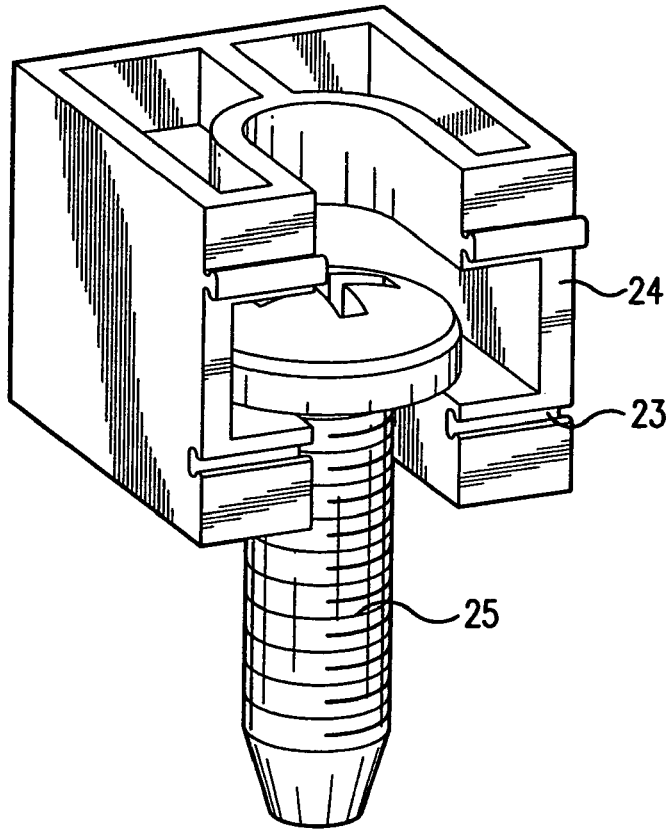

According to another feature of the invention, tongue and groove means 23 are provided for connecting together the adjacent end surfaces of plurality of the housings 15 of the movable connecting block 1 (FIGS. 14 and 16*b*), and for connecting together the ends of a plurality of the stationary first connecting blocks 2 (FIG. 15). Furthermore, the tongue and groove connecting means 23 may serve to connect to the ends of the assembled housings 15 a pair of end attachment units 24 (FIGS. 16*a*, 16*b* and 17*b*) having fastening screws 25 for fastening the movable connector block to the support housing S of the circuit board and associated connector block assembly, as shown in FIGS. 5-7. Additional conductors, such as IDC devices 26 (FIG. 15), may be connected with the stationary housing 2.

While in accordance with the provisions of the Patent Statutes the preferred forms and embodiments of the invention have been illustrated and described, it will be apparent to those skilled in the art that changes may be made without deviating from the invention described above.

What is claimed is:

1. An electrical connector block arrangement for connecting a plurality of external conductors (C) with the circuits of a printed circuit board (3), comprising:

(a) first connector block means (2) including:

(1) a first generally rectangular stationary housing (27) formed from electrically-insulating synthetic plastic material, said first housing being adapted for mounting on the printed circuit board;

(2) a row of first electrical contacts (7) carried by one side of said first housing; and (3) a plurality of conductive pins (8) operable to connect said first contacts with respective circuit of the printed circuit board;

(b) second connector block means (1) arranged for displacement between separated and connected conditions relative to said first connector block means, said second connector block means including;

(1) a second generally rectangular housing (15) formed from electrically-insulating synthetic plastic material;

(2) a row of second electrical contacts (6) carried by one side of said second housing for respective engagement with said first contacts when said first and second connector housings are in said connected condition; and (3) electrically conductive jumper means (12) arranged in said second housing for normally electrically connecting together a group of said second contacts; and (c) code means (19) mounted on one of said housings for disconnecting at least one contact of said second contact group from said jumper means.

2. A connector block arrangement as defined in claim 1, wherein said jumper means comprises a jumper member (12) formed from a resilient conductive metal sheet, said jumper member including:

(a) a generally V-shaped cross-sectional configuration and including a base portion (12*a*) extending longitudinally of said row of second contacts;

(b) said jumper member including a plurality of resilient finger portions (12*b*) reversely bent back from one edge of said jumper member base portion, said finger portions extending at an acute angle over said jumper member base portion being resiliently biased toward electrical engagement with associated ones of said second contacts, respectively.

3. A connector block arrangement as defined in claim 2, wherein said code means comprises a planar code member (19) formed from a non-conductive synthetic plastic material, said code member having a generally comb-like configuration including:

(1) a planar generally-rectangular base potion (19*a*) extending longitudinally of the associated row of contacts; and (2) a plurality of flat code bar portions (19*b*) extending orthogonally from said code member base portion for insertion between a corresponding one of said jumper fingers and the associated electrical contacts, thereby to disconnect said associated contacts from said jumper means.

4. A connector block arrangement as defined in claim 3, wherein at least one of said housing contains an opening (21, 22) in which said code member base portion is mounted, the lengths of said code bar portions being such that said code member is at least partially visible when said first and second connector blocks are in said separated condition.

5. A connector block arrangement as defined in claim 4, wherein the side face of said first connector block housing adjacent said second connector block housing contains a recess (22) in which the base portion of said code member is mounted, the code bar portions of said code member extending toward said second connector block housing.

6. A connector block arrangement as defined in claim 5, wherein said second connector block housing contains a transversely-extending through passage (21) extending normal to said first connector block side face, said jumper member being mounted in said through passage.

7. A connector block arrangement as defined in claim 3, wherein one of said first and second contacts comprises a plurality of flat male contacts (6); and further wherein the other of said first and second contacts comprises a plurality of tulip-shaped female contacts (7) associated with said male contacts, respectively.

8. A connector block arrangement as defined in claim 1, wherein said first connector block is sectional and comprises a plurality of said first housings (27); and connecting means (23) connecting together the ends of said first housings.

9. A connector block arrangement as defined in claim 1, wherein said second connector block is sectional and comprises a plurality of second connector housings; and connecting means (23) for connecting together the ends of said second connector housings.

10. A connector block arrangement as defined in claim 1, and further including:

(d) support means including a support wail (S) for supporting said first connector block means; and (e) attachment means (24, 25) for attaching said second connector block with said support wall.

11. A connector block arrangement as defined in claim 10, wherein said attachment means includes:

(1) an attachment housing (24);

(2) a fastening screw (25)carried by said attachment housing; and (3) connecting means (23) connecting said attachment housing to one end of said second connecting block means to position said screw for threaded connection with a corresponding threaded bore contained in said support wall.

12. A connector block arrangement for connecting a plurality of external conductors (C) with an electrical load (3), comprising:

(a) first connector block means (2) including:

(1) a first generally rectangular housing (27) formed from electrically-insulating synthetic plastic material;

(2) a row of first electrical contact means (7) carried by one side of said first housing;

(b) second connector block means (1) arranged for displacement between separated and connected conditions relative to said first connector block means, said second connector block means including;

(1) a second generally rectangular housing (15) formed from electrically-insulating synthetic plastic material;

(2) a row of second electrical contact means (6) carried by one side of said second housing for respective engagement with said first contact means when said first and second connector housings are in said connected condition, each of said second contact means including:

(a) an electrical contact (6), and (b) a C-shaped bus bar (9) having a central portion (9*b*) electrically connected with said electrical contact, and a first leg portion (9*c*); and (3) electrically conductive jumper means (12) arranged in said second housing for electrically connecting together a group of said second contact means, said jumper means including a plurality of resilient finger portions biased toward electrical engagement with said bus bar first leg portions, respectively; and (c) code means (19) mounted on one of said housings for disconnecting at least one contact of said second contact group from said jumper means.

13. A connector block arrangement as defined in claim 12, and wherein second housing contains a plurality of openings (4) adjacent said bus bars for receiving the bare ends of a plurality of external conductors (C), respectively; and further including a plurality of third contact means (11) mounted in said second connector block housing for connecting the conductor bare ends with the second leg portions of the associated bus bars, respectively.

14. A connector block arrangement as defined in claim 13, wherein each third contact means comprises screw-operated clamping means (11) for connecting the bare end of the external conductor to the associated bus bar.

15. A connector block arrangement as defined in claim 14, and further including:

(d) a printed circuit board defining the electrical load, said circuit board including a plurality of circuits; and (e) a plurality of pin means (8) connecting said first contacts with said circuit board circuits, respectively.

* * * * *